United States Patent [19]

Larkins et al.

[11] 4,022,651

[45] May 10, 1977

[54] APPARATUS FOR LAYING PRESSURE SENSITIVE TAPE FROM A TAPE ROLL

[76] Inventors: Frank D. Larkins, P.O. Box 6103B, Greenville, S.C. 29606; Bruce D. Anderson, 103 Indian Spring Drive, Greenville, S.C. 29607

[22] Filed: Jan. 19, 1976

[21] Appl. No.: 650,257

[52] U.S. Cl. ..... 156/577; 33/27 B

[51] Int. Cl.[2] ..... B44C 7/00; B43L 9/00

[58] Field of Search ..... 156/577, 574; 33/27 B, 33/27 F

[56] References Cited

UNITED STATES PATENTS

| | | | |
|---|---|---|---|
| 2,904,206 | 9/1959 | Bertschinger | 156/577 |
| 3,150,027 | 9/1964 | Moyer | 156/577 |
| 3,871,940 | 3/1975 | Antonioni | 156/577 |

*Primary Examiner*—Douglas J. Drummond
*Attorney, Agent, or Firm*—Bailey, Dority & Flint

[57] ABSTRACT

A tape laying device is illustrated having a vertical frame, a transverse pressure roll carried by the frame supporting same for rolling movement thereon, a tape roll support, a transverse guide bar having an open slot therein receiving a reverse side of said pressure sensitive tape and guiding same beneath the pressure roll for application to a surface to be marked, and an extension bar having rigid connection to a side of the frame and pivotal connection with respect to the surface being marked for use in laying tape in straight lines or circles.

1 Claim, 4 Drawing Figures

APPARATUS FOR LAYING PRESSURE SENSITIVE TAPE FROM A TAPE ROLL

This invention relates to a device for laying pressure sensitive tape wherein an intermediate guide is fixedly carried by a frame for receiving a side of the tape remote from the pressure sensitive adhesive and directing same beneath a pressure sensitive roll with guide means for use in laying a variety of tape patterns.

BACKGROUND OF THE INVENTION

A variety of devices have been provided for laying pressure sensitive tape such as those illustrated in U.S. Pat. Nos. 2,546,308, 3,483,064 and 3,617,434.

Generally, such devices utilize a tape roll support which directs the tape directly therefrom beneath a pressure roll for application to the surface to be marked. Other devices use guide means which require threading of the tape therethrough and are restricted to tape of a particular size for a given purpose.

Accordingly, it is an important object of this invention to provide a versatile tape applicator device which utilizes an open intermediate guide means which is fixedly carried between the tape supply and the pressure roller for receiving a remote side of the pressure sensitive tape and which may be removed and replaced to accommodate tape of different sizes or even several rolls of tape.

An important object of the invention, therefore, is to provide a versatile device capable of use in laying a variety of tapes in a variety of patterns.

Another important object of the invention is the provision of an extension bar which may be rigidly connected to a side of the frame and pivotally connected to the surface being marked for laying tape in a circle.

SUMMARY OF THE INVENTION

It has been found that a tape laying device may be constructed utilizing a vertical frame supported by a transverse pressure roll and positioning a transverse guide bar having flat sides received adjacent both ends thereof within a receptacle having flat sides carried by the frame wherein the guide bar has an open slot therein for receiving a remote side of the pressure sensitive tape and directing same beneath the pressure roll for application thereby to the surface being marked by the tape.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

The drawings illustrate apparatus for laying pressure sensitive adhesive tape from a tape roll for marking basketball courts and the like, including a vertical frame A. A transverse pressure roll B is carried by the frame supporting the frame for rolling movement thereon. Transverse tape roll supporting means C is carried within the frame A. A transverse guide bar D having an open guide slot therein is fixedly carried within the frame above the transverse pressure roll for receiving and guiding a side of the tape remote from said pressure sensitive adhesive in the slot as it is fed from a tape roll carried by the supporting means C and thence beneath the pressure roll B. Guide means E are aligned with the slot.

Figure 1:
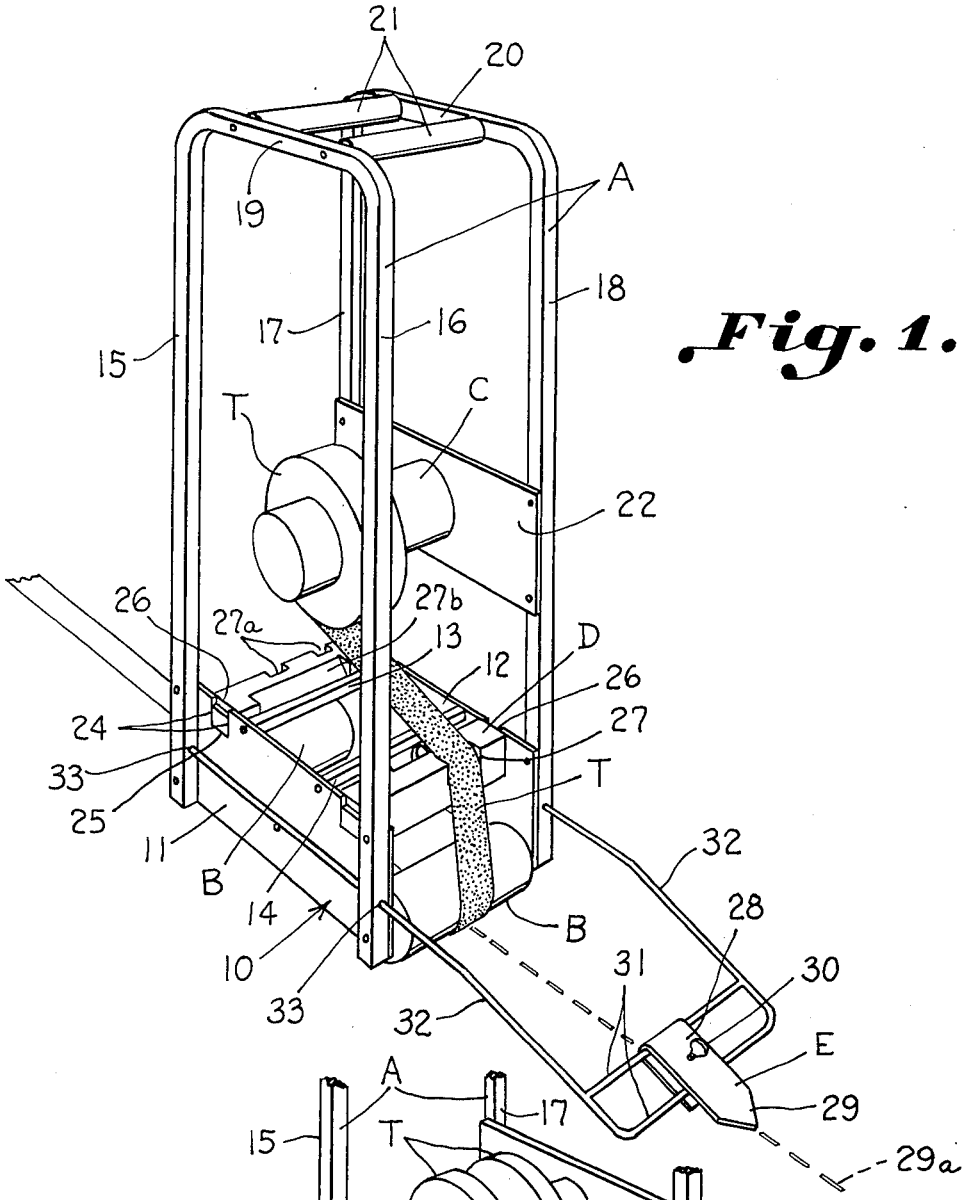
FIG. 1 is a perspective view illustrating a tape applicator device constructed in accordance with the present invention.

The vertical frame A includes a substantially rectangular lower support member broadly designated at 10. The lower support member has opposed side frame members 11 and 12 bridged by suitable intermediate support members 13 and 14. The vertical frame A also has vertical standards 15, 16, 17 and 18, one positioned adjacent each corner thereof. The standards on respective sides are bridged as at 19 and 20 forming downwardly facing U-shaped frame members. These U-shaped frame members are bridged by spaced, transverse supports 21 at the top. The transverse supports 21 also serve as handles for pushing the apparatus across a surface to be marked (FIG. 1).

A pair of transverse pressure rolls B are carried by the frame and support the frame for rolling movement thereon and are suitably journaled at their ends in the side frame members 12 and 13. It will be observed that the pressure rolls are of suitable size to conveniently apply the tape as well as transport the tape laying device across a surface being marked. Preferably the rolls are coated with hard rubber and the like to provide a pressure surface which may be readily cleaned and which is capable of applying considerable force to the tape firmly positioning same upon the surface being marked.

A transverse roll support means C is carried within the frame A upon an intermediate side support member 22. Preferably the supporting means is provided in the form of a round member which may be fixed as by a bolt 23 to the side frame member 22 and which is of suitable size to receive a roll of pressure sensitive tape for turning movement thereon. It will be observed that the support means C is supported on only one side so that the other side will be left open for reception of the tape.

Figure 2:
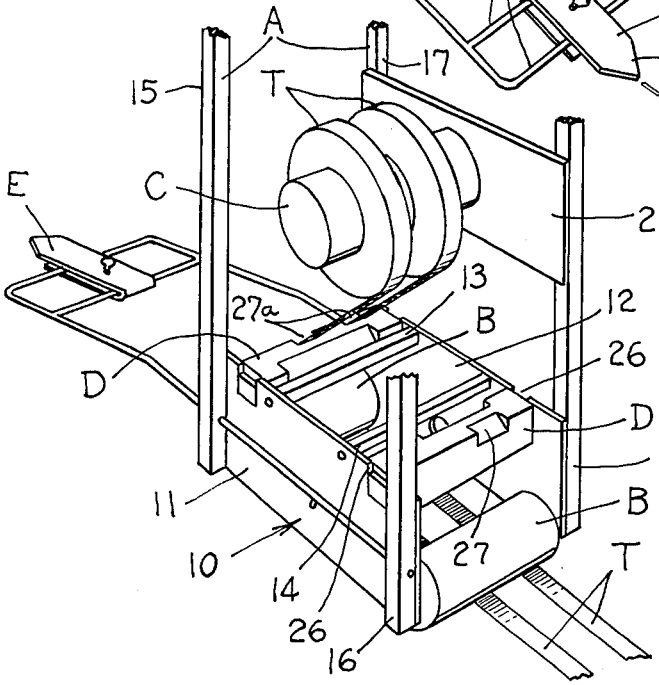
FIG. 2 is an enlarged, perspective view of a rear lower portion of the device illustrated in FIG. 1.
Figure 3:
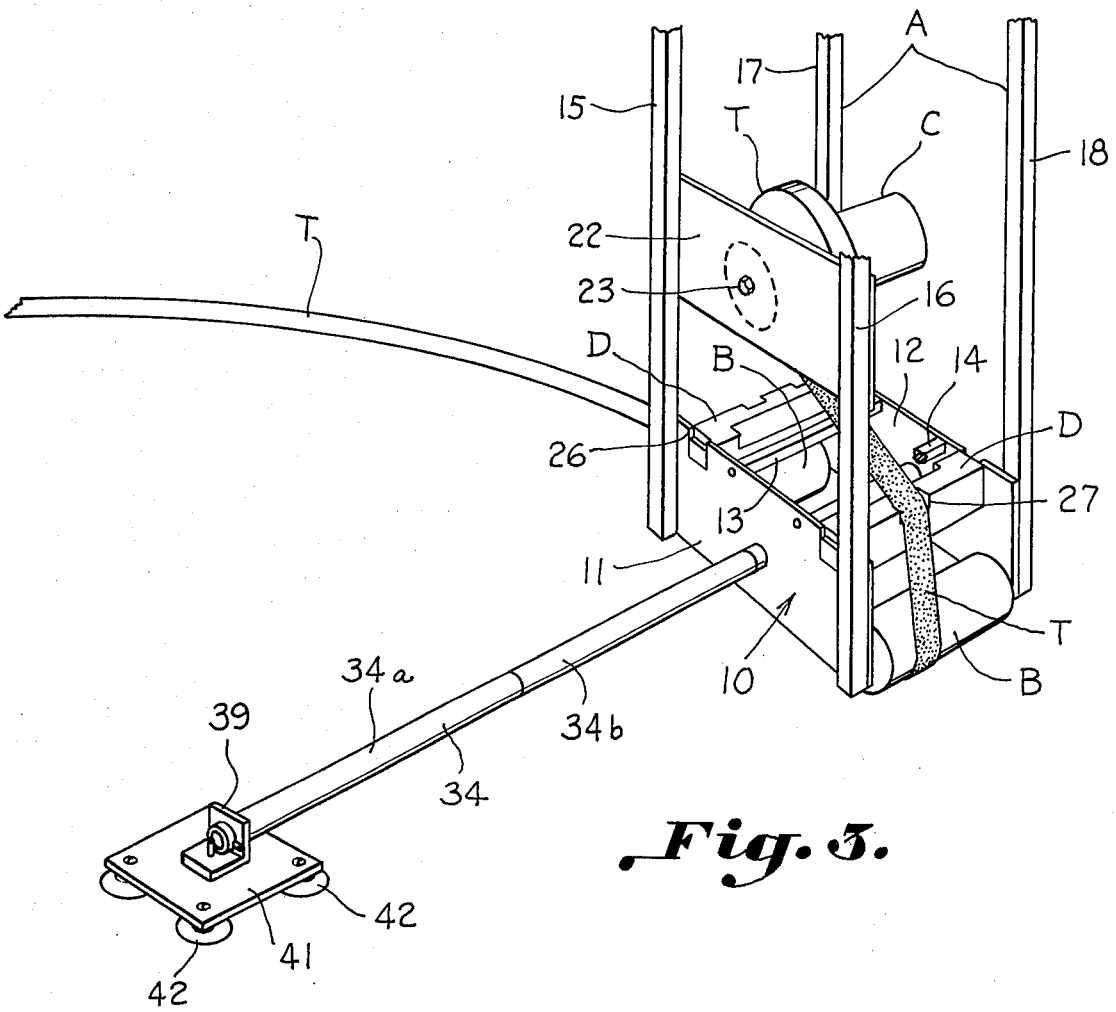
FIG. 3 is a perspective view similar to FIG. 1 illustrating the use of an attachment facilitating the laying of tape in a circular pattern.

A transverse guide bar D is carried above and slightly inwardly of each of the transverse pressure rolls B. The transverse guide bars D are supported at each end thereof between flat sides 24. A flat horizontal bottom 25 is provided forming rectangular cutout portions 26, open at the top for receiving opposite ends of each of the guide bars D. Each of the guide bars D is so positioned as to receive a side of the tape T remote from the pressure sensitive adhesive within open slots 27 carried therein. It will be observed in FIG. 2 that two rolls of tape are being guided into spaced slots 27*a*. Opposite the slots 27*a*, it will be observed that a slot 27*b* is provided to accommodate a larger tape. Since the respective slots occur at corners of the substantially rectangular bars D, such slots may be selectively positioned to receive a variety of tapes by merely removing the bars from the receiving slots 26 and repositioning them so that the desired slots 27, 27*a*, and 27*b* and the like are in a position to receive and guide the tape.

Suitable guide means E are aligned with the slot 27 (FIG. 1). The guide means E includes a bracket portion 28 carrying a pointer 29. The pointer 29 serves as a guide as when following a short mark 29*a* as is often used to locate positions whereon the tape is to be laid. The bracket portion 28 is secured as by a thumbscrew 30 across end support members 31. The end support members have a pair of spaced, marginal support members 32 which are carried within suitable aligned openings 33 carried upon the vertical frame A.

Figure 4:
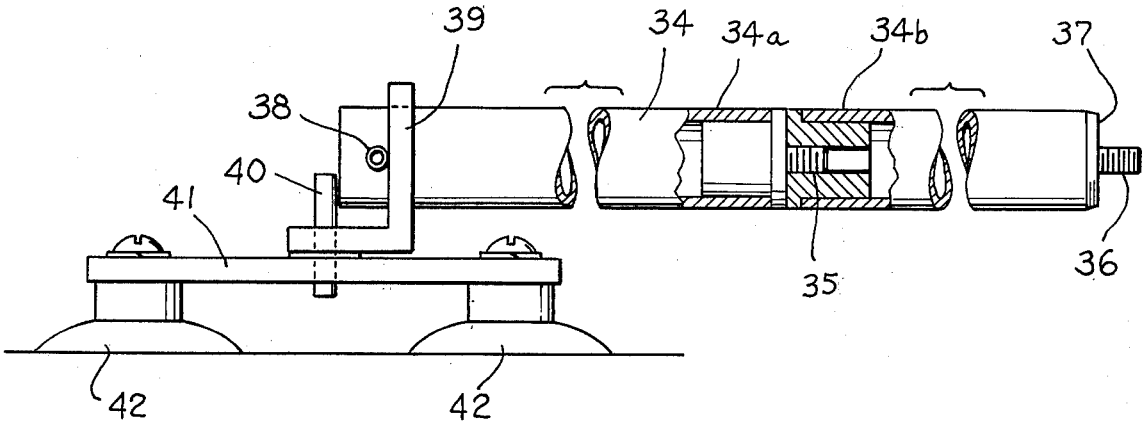
FIG. 4 is an enlarged, side elevation of the attachment illustrated in FIG. 3.

The attachment for accommodating the device to laying tape in circular patterns includes a rigid extension bar 34 which may include a number of sections such as 34*a* and 34*b*, which may be threadably connected to each other as at 35 (FIG. 4). A threaded element 36 projects from a remote end of the section 34*b* so as to be received within an internally threaded opening within the side frame member 11. The rod portion 34*b* is carried by the side frame member 11 so that a flat end portion 37 thereof engages the side frame member 11 to provide a fixed connection for the extension therewith. A remote end of the bar, section 34*a*, carries a transverse pin 38, to limit outward movement of the bar 34*a* with respect to an opening within the angle support 39 which receives the extension rod 34*a*. The angle support 39 is pivoted upon a vertical pin 40 which is, in turn, carried by a support bridge 41. The support plate 41 is carried and affixed to the surface being marked as by suction cups 42 adjacent each corner thereof.

While a preferred embodiment of the invention has been described using specific terms, such description is for illustrative purposes only, and it is to be understood that changes and variations may be made without departing from the spirit or scope of the following claim.

We claim:

1. For use in apparatus for laying pressure sensitive tape from a roll for marking basketball courts and the like having a vertical frame, a pair of transverse pressure roll carried by said frame supporting said frame for rolling movement thereon, transverse tape roll supporting means carried within said frame and a transverse guide bar having a guide slot therein carried within said frame above said transverse pressure roll for receiving and guiding said tape in said slot as it is fed from a tape roll carried by said supporting means, and thence beneath said pressure roll, the improvement comprising: a rigid extension bar, means connecting said extension bar rigidly to said frame transversely thereof, (and) means pivotally connecting said extension bar with respect to the surface being marked remote from said frame including a base attaching means removeable fastening the base to the surface to be marked, a vertical free standing pin fixed to said base and connecting means pivotally carried by said pin and removeable attached to said extension bar remote from said frame.

* * * * *